US010065062B2

(12) United States Patent
Stewart

(10) Patent No.: US 10,065,062 B2
(45) Date of Patent: Sep. 4, 2018

(54) EXERCISE APPARATUS WITH EDDY CURRENT RAIL

(71) Applicant: Precor Incorporated, Woodinville, WA (US)

(72) Inventor: Jonathan M. Stewart, Seattle, WA (US)

(73) Assignee: Precor Incorporated, Woodinville, WA (US)

( * ) Notice: Subject to any disclaimer, the term of this patent is extended or adjusted under 35 U.S.C. 154(b) by 229 days.

(21) Appl. No.: 14/880,323

(22) Filed: Oct. 12, 2015

(65) Prior Publication Data

US 2017/0100621 A1 Apr. 13, 2017

(51) Int. Cl.

| | |
|---|---|
| ***A63B 22/00*** | (2006.01) |
| ***A63B 21/005*** | (2006.01) |
| ***A63B 22/20*** | (2006.01) |
| ***A63B 22/06*** | (2006.01) |

(52) U.S. Cl.

CPC ..... *A63B 21/0052* (2013.01); *A63B 22/0007* (2013.01); *A63B 22/0664* (2013.01); *A63B 22/205* (2013.01); *A63B 2022/067* (2013.01)

(58) Field of Classification Search

CPC ..... A63B 21/00192; A63B 21/005; A63B 21/0051; A63B 21/0052; A63B 21/0056; A63B 21/0057; A63B 22/20–22/208; A63B 2022/206; A63B 22/04; A63B 22/0076; A63B 22/06; A63B 22/0664; A63B 2022/067–2022/0688

See application file for complete search history.

(56) References Cited

U.S. PATENT DOCUMENTS

| | | | | |
|---|---|---|---|---|
| 5,031,900 | A * | 7/1991 | Leask | A63B 21/0052 482/5 |
| 7,658,698 | B2 | 2/2010 | Pacheco et al. | |
| 7,691,034 | B2 | 4/2010 | May et al. | |
| 7,704,192 | B2 | 4/2010 | Dyer et al. | |
| 7,780,577 | B2 | 8/2010 | Arnold | |
| 7,931,566 | B1 | 4/2011 | Radke et al. | |
| 7,981,001 | B2 | 7/2011 | Stearns et al. | |
| 8,235,873 | B1 | 8/2012 | Stearns et al. | |
| 8,323,155 | B2 | 12/2012 | Ohrt et al. | |
| 8,585,561 | B2 | 11/2013 | Watt et al. | |
| 8,663,072 | B2 | 3/2014 | Stewart et al. | |
| 8,672,814 | B2 | 3/2014 | Hopkins | |
| 8,851,235 | B2 | 10/2014 | Allington et al. | |
| 8,876,668 | B2 | 11/2014 | Hendrickson et al. | |
| 8,882,637 | B2 | 11/2014 | Ainsworth et al. | |
| 8,932,185 | B2 | 1/2015 | Hsieh | |
| 9,011,291 | B2 | 4/2015 | Birrell | |
| 9,050,498 | B2 | 6/2015 | Lu et al. | |
| 9,126,078 | B2 | 9/2015 | Anderson et al. | |
| 9,272,182 | B2 | 3/2016 | Ohrt et al. | |
| 9,418,349 | B2 | 8/2016 | Ainsworth et al. | |
| 9,468,794 | B2 | 10/2016 | Barton | |

(Continued)

*Primary Examiner* — Stephen R Crow

(74) *Attorney, Agent, or Firm* — Terence P. O'Brien; Todd A. Rathe

(57) ABSTRACT

An apparatus and method operably coupled a movable member of an exercise apparatus to a carriage such a movement of the movable member moves the carriage along a rail. A magnetic portion carried by the carriage induces eddy currents in the rail to resist movement of the carriage along the rail to resist movement of the movable member.

24 Claims, 7 Drawing Sheets

(56) References Cited

U.S. PATENT DOCUMENTS

| | | | | |
|---|---|---|---|---|
| 9,468,795 | B2 | 10/2016 | Arnold et al. | |
| 9,579,555 | B2 | 2/2017 | Lagree | |
| 9,586,085 | B2 | 3/2017 | Arnold et al. | |
| 9,586,089 | B2 | 3/2017 | Lagree | |
| 9,597,540 | B2 | 3/2017 | Arnold | |
| 9,604,096 | B2 | 3/2017 | Arnold et al. | |
| 9,636,543 | B2 | 5/2017 | Dyer et al. | |
| 9,643,051 | B1 | 5/2017 | Lagree | |
| 9,700,755 | B2 | 7/2017 | Giannelli et al. | |
| 9,724,559 | B2 | 8/2017 | Chang et al. | |
| 9,724,566 | B2 | 8/2017 | Birrell | |
| 2003/0195095 | A1* | 10/2003 | Endelman | A63B 21/023 482/142 |
| 2004/0241631 | A1* | 12/2004 | Nizamuddin | A63B 21/055 434/253 |
| 2010/0167877 | A1* | 7/2010 | Grind | A63B 22/001 482/52 |
| 2010/0167883 | A1* | 7/2010 | Grind | A63B 22/001 482/71 |
| 2010/0234185 | A1 | 9/2010 | Watt et al. | |
| 2012/0135842 | A1* | 5/2012 | Verkaik | A63B 21/068 482/5 |
| 2014/0080675 | A1 | 3/2014 | Anderson et al. | |
| 2014/0248999 | A1 | 9/2014 | Lu et al. | |
| 2015/0352402 | A1* | 12/2015 | Arnold | A63B 23/03591 482/57 |
| 2015/0360083 | A1* | 12/2015 | Lagree | A63B 24/0075 482/130 |
| 2015/0360113 | A1* | 12/2015 | Lagree | A63B 71/0054 482/121 |
| 2016/0023082 | A1 | 1/2016 | Hamilton | |
| 2016/0089562 | A1 | 3/2016 | Grossmann | |
| 2016/0151660 | A1 | 6/2016 | Ohrt et al. | |
| 2016/0263415 | A1 | 9/2016 | Chen et al. | |
| 2016/0263417 | A1 | 9/2016 | Golesh | |
| 2016/0346586 | A1 | 12/2016 | Pullins et al. | |
| 2016/0375300 | A1 | 12/2016 | Chang et al. | |

* cited by examiner

EXERCISE APPARATUS WITH EDDY CURRENT RAIL

BACKGROUND

People often use exercise machines as part of a workout routine. Many exercise machines require the person exercising to move a member against a provided resistance. Existing mechanisms providing the resistance are often space consuming, complex and/or costly to implement.

BRIEF DESCRIPTION OF THE DRAWINGS

FIG. 3 is a flow diagram of an example method that may be carried out by the apparatus of FIG. 1 or 2.

DETAILED DESCRIPTION OF THE EXAMPLE EMBODIMENTS

Figure 1:
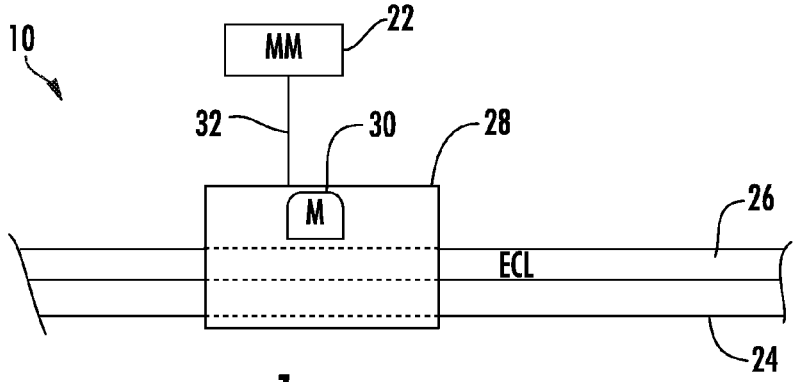
FIG. 1 is a schematic diagram of an example exercise apparatus.

FIG. 1 is a schematic diagram of an example fitness equipment unit or exercise apparatus 10. Exercise apparatus 10 comprises an exercise unit or device by which a person exerts force against a movable member to move the movable member against a source of resistance. Examples of exercise apparatus 10 include, but are not limited to, elliptical machines, rowing machines, striding machines, and the like. As will be described hereafter, exercise apparatus 10 provides a source of resistance against movement of a movable member in a less space consuming, less complex and/or less costly manner as compared to many existing exercise devices.

Exercise apparatus 10 comprises movable member 22, rail 24, eddy current layer 26, carriage 28 and magnet 30. Movable member 22 comprises a member by which a person exerts force to movable member 22 and carriage 28 along rail 24. In one implementation, movable member 22 comprises a footpad upon which a person rests his or her feet while exerting force against movable member 22 so as to move member 22 and carriage 28 along rail 24. In other implementations, movable member 22 may have other configurations, such as pedals, swing-arms, levers or other mechanical elements.

Rail 24 comprises an elongate structure, such as a track, along which carriage 28 moves upon being driven by movable member 22. Rail 24 guides movement of carriage 28 and movable member 22. In one implementation, rail 24 comprises a linear rail in which carriage 28 and/or member 22 move linearly in the fore and aft directions of exercise apparatus 10. In another implementation, rail 24 is inclined or is curved, depending upon a path of motion of carriage 28 and member 22.

Eddy current layer 26 comprises a layer of electrically conductive material extending along a length of rail 24. In one implementation, eddy current layer 26 is a coating upon rail 24. In another implementation, eddy current layer 26 is a plate, laminate or other member welded, jointed, bonded, fastened or otherwise secured along the length of rail 24.

Carriage 28 comprises a member or structure movable along rail 24 and connected to movable member 22 by linking portion 32 such that movement of movable member 22 also results in movement of carriage 28 along rail 24. In one implementation, carriage 28 extends along a side of rail 24. In another implementation, carriage 28 surrounds one or more sides of rail 24. In yet another implementation, carriage 28 extends below or above rail 24.

Magnet 30 comprises a magnetic member, such that permanent magnet or electromagnet. Magnet 30 is carried by carriage 28 in a position opposite to eddy current layer 26 such that movement of magnet 30 relative to eddy current layer 26 creates eddy currents within eddy current layer 26 through electromagnetic induction, were such current produces movement resistance and heat, or electricity. Movement of the magnet 30 relative to eddy current 26 occurs in the presence of magnetic fields or magnetic flux between magnet 30 and eddy current layer 26, which resist relative movement of magnet 30 and eddy current layer 26. As a result, magnet 30 and eddy current layer 26 cooperate to function or serve as a brake or source of resistance against movement of movable member 22.

In the example shown in FIG. 1, eddy current resistance source 132 is configured such that the relationship between eddy current layer 326 and magnet 330 along the entire length of rail 324 is uniform. In other words, eddy current layer 326 has a uniform or consistent shape, size and material composition along the entire length of rail 324. At the same time, carriage 328 is positioned upon or guided along rail 324 so as to support magnet 330 any uniform or consistent spacing and positioning relative to eddy current layer 326 along the entire longitudinal length of rail 324.

Figure 2:
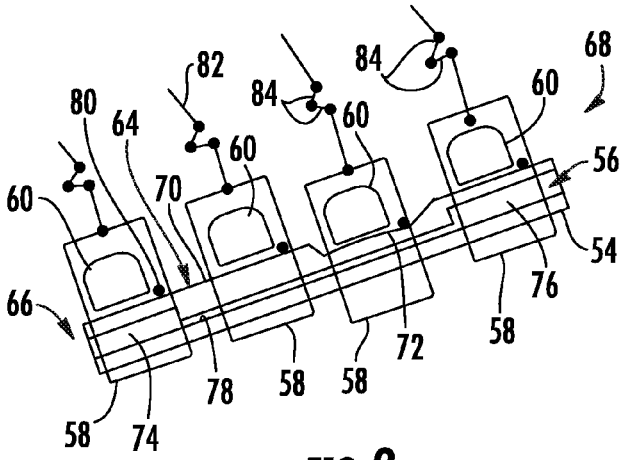
FIG. 2 is a schematic diagram of another example exercise apparatus.

FIG. 2 illustrates exercise apparatus 50, another example implementation of exercise apparatus 10. Exercise apparatus 50 is similar to exercise apparatus 10 except that exercise apparatus 50 is configured such that the relationship between eddy current layer and magnet varies along the longitudinal length of the rail. Exercise apparatus 50 comprises rail 54, eddy current layer 56, carriage 58 and magnet 60. FIG. 2 illustrates carriage 58 and magnet 60 at various locations along rail 54 during movement of movable member 22 (shown in FIG. 1).

Rail 54 is similar to rail 24 except that rail 54 is inclined and is illustrated as specifically comprising cam surface 64.

Cam surface 64 extends along the length of rail 54 from first end 66 to second end 68. Cam surface 64 cooperates with a cam follower associated with carriage 58 to control the positioning of carriage 58 along rail 54 and to control the relative positioning of magnet 60 relative to eddy current layer 56. In the example illustrated, cam surface 64 comprises a first portion 70 and second portion 72. Portion 72 supports carriage 58 and magnet 60 at different spacings relative to eddy current layer 56. Although cam surface 64 is illustrated as extending along the top surface of rail 54, in other implementations, cam surface 64 may be provided other locations, such as within or alongside of rail 54. Although cam surface 64 is illustrated as including two portions 70, 72, in other implementations, cam surface 64 may include more than two portions. Although portions 70 and 72 are illustrated as being flat, but for the ramp or sloped entry and exit to portion 72, in other implementations, cam surface 64 can be curved or ramped, inclined or comprises one or more curved portions. In other implementations, length and/or positioning of portions 70, 72 may vary.

Eddy current layer 56 is similar to eddy current layer 26 except that eddy current layer 56 varies in both shape and material composition along the length of rail 54. In the example illustrated, eddy current layer 56 comprises eddy current layer end portions 74, 76 and intermediate portion 78. End portions 74, 76 are located along or at end portions of rail before proximate ends 66, 68, respectively. End portions 74, 76 are configured so as to extend into closer proximity to magnet 60 supported by carriage 58 as compared to intermediate portion 78. In the example illustrated in which magnet 60 is supported above eddy current layer 56, portions 74, 76 have a height greater than intermediate portion 78. Because end portions 74, 76 extend into closer proximity with magnet 60 when magnet 60 is opposite to such end portions as compared to the proximity of magnet with respect to intermediate portion 78, when magnet 60 is opposite to portion 78, end portions 74, 76 provide higher levels of resistance against movement for a given velocity of carriage 58/magnet 60 along rail 54 to provide enhanced braking proximate to ends 66, 68 of rail 54.

In the example illustrated, end portion 76 has a different material composition as compared to end portion 74. In one implementation, end portion 76 is formed from one or more materials having a higher level of electrical conductivity as compared to end portion 74 such that the amount of eddy current induced in end portion 76 for a given velocity of carriage 58 is larger than the amount of eddy current induced an end portion 74 for the same given velocity of carriage 58. As a result, the construction or configuration of eddy current layer 56 accommodates the expected slower speed of carriage 58 proximate to a top of the inclined rail 54. In particular, the material composition of portion 76 has greater conductivity to at least mitigate the drop in eddy current resistance that might otherwise occur due to the anticipated slower movement of carriage 58 towards the top of rail 54.

Although eddy current layer 56 is illustrated as having three distinct portions 74, 76 and 78, in other implementations, eddy current layer 56 may comprise a greater or fewer of such portions. Although eddy current layer 56 is illustrated as having portions with different material compositions or with different electrical conductivities, in other implementations, the material composition of eddy current layer 56 is uniform. Although portions 74, 76 and 78 are illustrated as being substantially flat with stepped junctions, in other implementations, each of portion 74, 76 and/or 78 are curved in shape or are tapered or ramped in shape, providing gradual changes in proximity to magnet 60 and gradual changes in the amount or rate at which eddy current resistance or braking is provided. Although eddy current layer 56 is illustrated as providing enhanced resistance proximate to ends 66, 68 of rail 54, in other implementations, eddy current layer 56 provides alternative patterns or layouts of resistance levels along the length of rail 54.

Carriage 58 is similar to carriage 28 except that carriage 58 is specifically illustrated as comprising cam follower 80 and is specifically illustrated as being coupled to movable member 22 (shown in FIG. 1) by adjusting linkage 82. Cam follower 80 rides along and in contact with cam surface 64 to control the positioning of carriage 58 and magnet 60 relative to eddy current layer 56 along the length of rail 54. In one implementation, cam follower 80 comprises one or more rollers. In yet another implementation, cam follower 80 comprises other low friction surfaces that slide along the surface of cam surface 64.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Adjusting linkage 82 is operably coupled carriage 58 to movable member 22. Adjusting linkage 82 has an adjustable length to accommodate differences in the spacing between carriage 58 and movable member 22 caused by the interaction between cam follower 82 and cam surface 64. In the example illustrated, adjusting linkage 82 comprises intermediate extension linkages 84 which are pivotally connected to one another and pivotally connect to a remainder of linkage 82. Extension linkages 84 fold and unfold to accommodate the different spacing between carriage 58 and movable member 22. In other implementations, linkage 82 comprises one or more springs to accommodate differences in the spacing between carriage 58 and movable member 22 caused by the interaction between cam follower 82 and cam surface 64. In implementations where cam surface 64 is uniform along the length of rail 54 such that the spacing between carriage 58 and movable member 22 is also uniform along the length of rail 54, the length adjustable nature of linkage 82 may be omitted.

Figure 3:
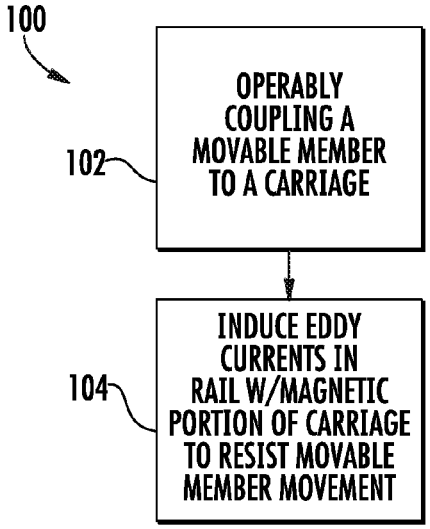
FIG. 3 illustrating an example carriage in different positions along an example rail.

FIG. 3 is a flow diagram of an example method 100 for providing a source of resistance to an exercise apparatus, such as exercise apparatus 10. As indicated by block 102, movable member 22 is operably coupled to carriage 28 is movable along rail 24. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

As indicated by block 104, eddy currents are induced in eddy current layer 26 extending along rail 24 by a magnetic portion carried by carriage 28 upon movement of carriage 28 along rail 24. The inducement of eddy currents resists relative movement of magnet 30 and carriage 28 to serve as a source of resistance to the movement of movable member 22.

Figure 4:
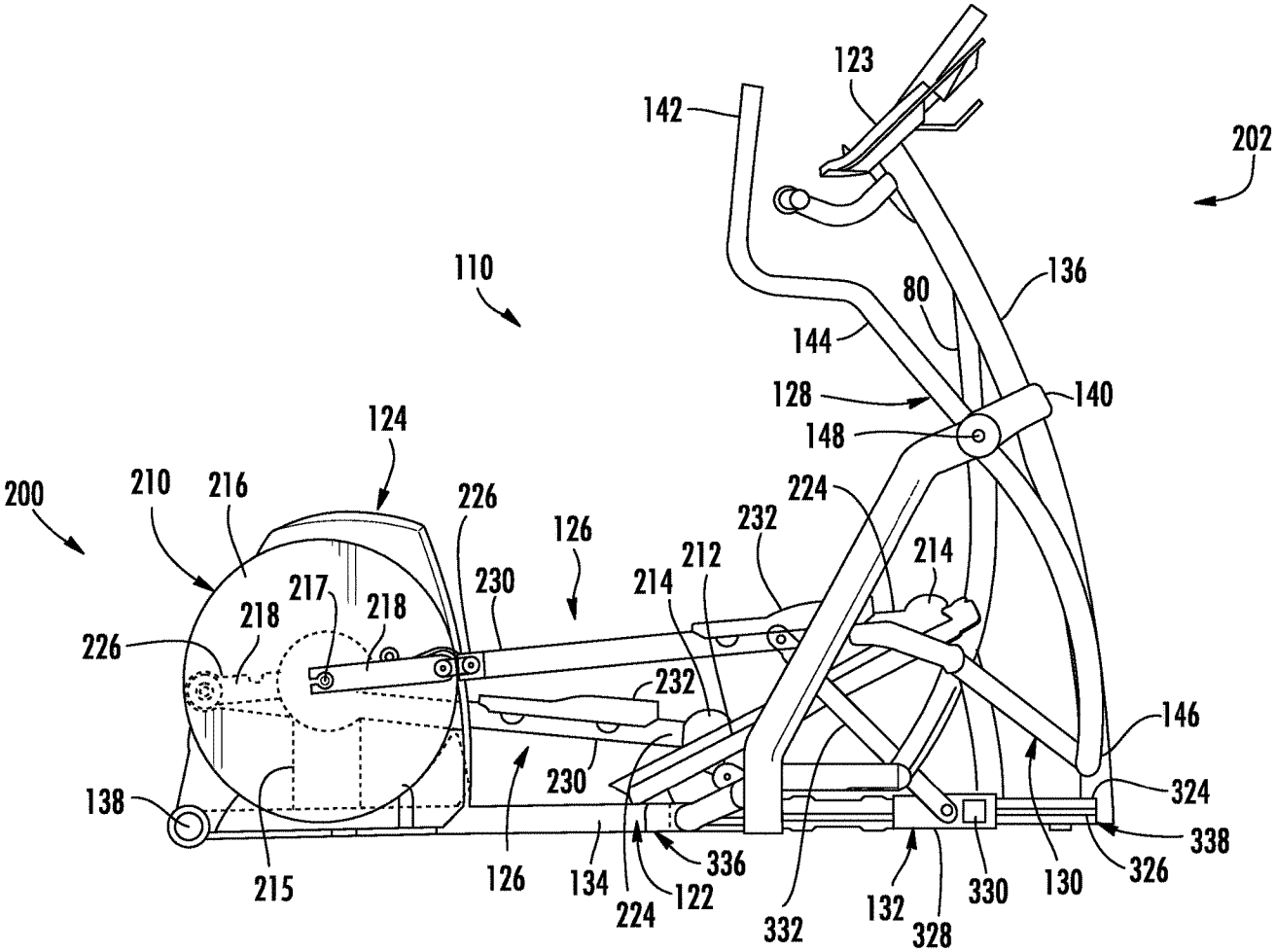
FIG. 4 is a side view of another example exercise apparatus.
Figure 5:
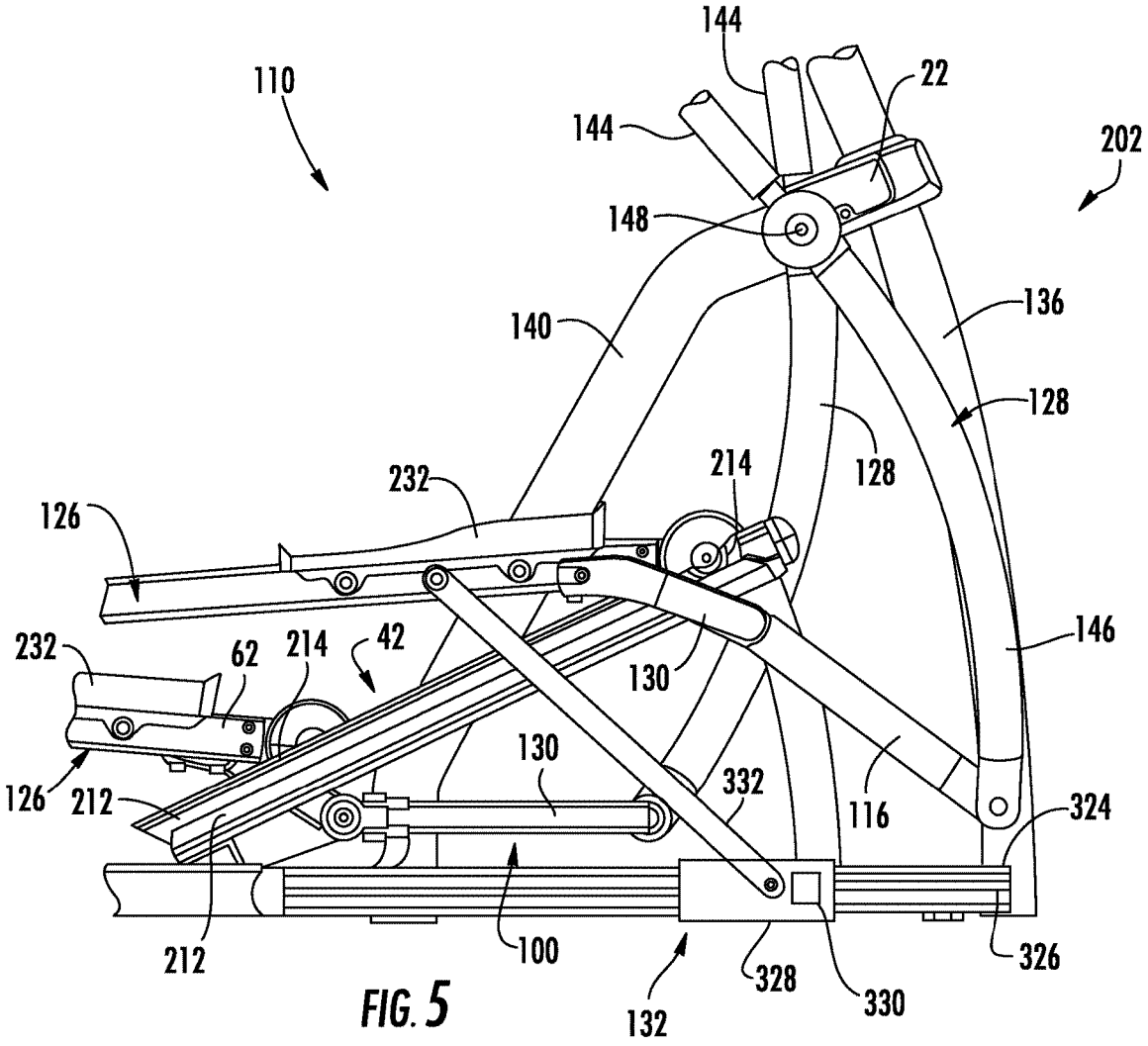
FIG. 5 is an enlarged fragmentary side view of the exercise apparatus of FIG. 4.

FIGS. 4 and 5 illustrate exercise apparatus 110, an example implementation of exercise apparatus 10. Exercise apparatus 110 comprises an elliptical exercise machine. Exercise apparatus 110 comprises frame 122, control interface 123, guide 124, foot links 126, swing arms 128, connection linkages 130 and eddy current resistance source 132.

Frame 122 comprises one or more structures configured to support the remaining structures are components of exercise device 120 relative to a wall or floor. In the particular example illustrated, frame 122 includes a generally horizontal portion 134, a vertical portion 136, stabilizer portions 138 and swing arm supports 140. Horizontal portion 134 extends along a floor or other support surface while vertical portion 136 extends upwardly from horizontal portion 134. Horizontal portion 134 supports guide 124 while portion 136 supports swing arms 128 and control interface 123.

Stabilizer portions 138 transversely extend outwardly from horizontal portion 134 to stabilize and support horizontal portion 134. In the example illustrated, stabilizer portion 138 is located at a rear 200 of frame 122. In other embodiments, stabilizer portions 138 may have other configurations, may be provided in other locations along frame 122 or may be omitted.

Swing arm supports 140 transversely project from vertical portion 136 proximate to front 202 of frame 122. Swing arm supports 140 pivotably support swing arms 128 for pivotable or rotational movement about axis 148. In particular embodiments, swing arm supports 140 may apply a selected and controlled varying resistance to pivotal movement of swing arms 128. In other embodiments, this feature may be omitted.

Control interface 123 comprises an electronic device configured to interface with a person using exercise apparatus 110. In one embodiment, interface 123 facilitates input of instructions or commands by the person or from an external source. Such commands may be used to set or establish levels of resistance, speed or other settings to vary or control work out parameters. In one embodiment, interface 123 may additionally or alternatively be configured to provide the person with information or feedback regarding the current workout. In particular embodiments, interface 123 may additionally be configured to provide a person using exercise apparatus 110 with information regarding exercise goals, past workouts, recommended settings or entertainment information, such as news, videos or music. In one embodiment, control interface 123 may be configured to communicate with other external electronic devices, such as other computers, servers or portable devices in a wired or wireless fashion.

In one embodiment, interface 123 may include one or more displays that provide the user with visual information. In one embodiment, interface 123 may additionally include one or more speakers providing audible information or entertainment. Interface 123 may additionally include one or more microphones facilitating entry of audible commands in addition to or as an alternative to manual interfaces, such as touchpads, push buttons, slides, toggles, switches or touch screens.

Guide 124 comprises an arrangement of one or more structures or one or more mechanisms configured to facilitate movement of foot links 126 relative to frame 122 in one or more paths or manners. Guide 124 controls movement of foot links 126 such that motion or movement of foot links 126 has a reciprocating component. In the embodiment illustrated, guide 124 is configured such that foot links 126 reciprocate in an alternating fashion with respect to one another generally towards and away from control interface 123 in forward and rearward directions. In the example illustrated, guide 124 is configured such that rearward portions of foot links 126 are constrained to move in an orbital path such that the overall motion of foot links 126 is elliptical.

In the example illustrated, guide 124 includes orbital mechanism 210, guide tracks 212 and engagement rollers 214. Orbital mechanism 210 comprises a mechanism operably connected to rearward portions of foot links 126 and configured so as to constrain movement of rear portions of foot links 126 in an orbital path. In the embodiment illustrated, orbital mechanism 210 comprises axel supports 215, flywheel 216 and crank arms 218. Axel supports 215 extend upward from horizontal portion 134 of frame 122 to rotationally support flywheel 216 about a central axis 217.

Each of crank arms 218 has a first end rotationally supported about the central axis 217 and a second end rotationally connected to one of foot links 126 and wherein the other of the crank arms 216, 218 has a first end rotationally supported about the central axis and a second end rotationally connected to the other of foot links 126. An example orbital mechanism 210 is described in co-pending U.S. patent application Ser. No. 11/054,376, published on Aug. 24, 2006 as publication US 2006/0189445, the full disclosure of which is hereby incorporated by reference. In other implementations, ends of foot links 126 are rotationally connected to flywheel 216 at locations eccentric to axis 217. In still other embodiments, flywheel 216 is omitted.

Guide tracks 212 comprise elongate surfaces proximate a forward end of foot links 126 and configured to guide and direct reciprocal movement of a forward end of foot links 126. In the embodiment illustrated down a guide tracks 212 are inclined. For example, in one embodiment, guide tracks 212 are inclined at approximately 30 degrees. Guide tracks 212 receive engagement rollers 214. In other implementations, guide tracks 212 extend at other inclinations or are horizontal. Although guide tracks 212 are illustrated as being linear and as extending parallel to one another, in other implementations, guide tracks 212 curve upwardly curved inwardly. In some implementations, guide tracks 212 when linearly converge towards one another towards the front 202.

Engagement rollers 214 comprise rollers rotationally supported at forward portion of foot links 126. Engagement rollers 214 are configured to roll and move along their respective guide tracks 212. Guide tracks 212 and engagement rollers 214 cooperate with one another to retain engagement rollers 214 relative to guide tracks 212.

Each foot link 126 comprises one or more structures configured to engage a person's leg or foot such that movement of the person's leg or foot causes movement of foot link 126. In the embodiment illustrated, each foot link 126 includes a support 230 and a foot pad or foot rest 232. Support 230 comprises an elongate bar, rod or otherwise rigid structure having a forward end 224 supporting engagement roller 214 and a rear end 226 connected to orbital mechanism 210. Each foot rest 232 comprises a pedal or other surface upon which a person may place his or her foot to transfer force to foot link 126. In one embodiment, foot rests 232 are configured to form toe straps and/or toe and heel cups which aid in forward motion recovery at the end of a rearward or forward striding motion of a user's foot.

Swing arms 128 comprise one or more structures configured to be gripped by a person's hand and to be reciprocated to exercise a person's arms and upper body. Each swing arm 128 includes a gripping portion 142, an intermediate portion 144 pivotably connected to support 140 of frame 122 and an end portion 146 pivotably coupled to its associated foot link 126. Gripping portion 142 comprises that portion of swing arm 128 configured to be grasped or gripped by a person's hand. Intermediate portion 144 facilitates pivotal movement of swing arm 128 about the substantially horizontal axis 148. Although swing arms 128 are illustrated as being bowed, in other embodiments, swing arms 128 may have other shapes, relative dimensions and configurations.

Each connection link 130 comprises one or more segments or links configured to connect foot link 126 and swing arm 128 such that movement of foot link 126 and swing arm 128 is coordinated. In one embodiment, connection link 130 is configured and appropriately connected to foot link 126 and swing arm 128 such that when foot link 126 is moving forwardly (towards control interface 123), swing arm 128 is moving rearwardly. When foot link 126 is moving rearwardly, swing arm 128 is moving forwardly. In other words, when foot link 126 is in a forward most position, the connection between connection link 130 and swing arm 128 is on an opposite side of axis 148 as gripping portion 142. In some embodiments, connection links 130 may be disconnected from either foot links or 126 or swing arms 128. In still other embodiments, connection links 130 may be omitted, wherein swing arms 128 swing independent of foot links 126 or are stationary.

Eddy current resistance source 132 comprises a source of resistance against movement of foot links 126 in the horizontal or fore and aft directions. Eddy current resistance source 132 utilizes induced eddy currents resulting from movement of a magnet relative to an electrically conductive structure. Eddy current resistance source 132 comprises a rail 324, an eddy current layer 326, a carriage 328 and a magnetic portion or magnet 330 for each of foot links 126. Rail 324 comprises an elongate structure, such as a track, along which carriage 328 moves upon being driven by its associated for link 126 and foot rest 232. In the example illustrated, rail 324 is located outwardly of horizontal portion 134, transversely spaced from a longitudinal or fore and aft centerline of exercise apparatus 110 opposite to its associated foot link 126. Rail 324 has a longitudinal length sufficient to cover the longest fore and aft or longitudinal stride of foot rest 232. In the example illustrated, rail 324 extends from a rearward end point 336 to a forward end point 338.

Rail 324 guides movement of carriage 328. In the example illustrated, rail 324 comprises a linear rail linearly extending in the fore and aft directions of exercise apparatus 110. In another implementation, rail 324 is inclined, similar to the inclination of tracks 212. In another implementation, rail 324 is curved. In one implementation, the shape and length of rail 324 is dependent upon a path of motion of carriage 328 and a front portion of each of foot links 126.

Eddy current layer 326 (schematically shown) comprises a layer of electrically conductive material extending along a length of rail 24. In one implementation, eddy current layer 326 is a coating upon rail 324. In another implementation, eddy current layer 326 is a plate, laminate or other member welded, jointed, bonded, fastened or otherwise secured along the length of rail 324. In yet another implementation, eddy current layer 326 is integrally formed as a single unitary body with rail 324. For example, in one implementation, rail 324 is itself formed from an electrically conductive material and is spaced sufficiently close to magnet 330 such that rail 324 also serves as eddy current layer 326.

Carriage 328 (schematically shown) comprises a member or structure movable along rail 324 and connected to its associated foot link 126 and foot rest 232 by linking portion 332 such that movement of his associate for link 126 and foot rest 232 also results in movement of carriage 328 along rail 324. In one implementation, carriage 28 extends along a side of rail 24. In another implementation, carriage 28 surrounds one or more sides of rail 24. In yet another implementation, carriage 28 extends below or above rail 24 sources support magnet 30 opposite to a current layer 26.

Magnet 330 comprises a magnetic member, such that permanent magnet or electromagnet. Magnet 330 is carried by carriage 328 in a position opposite to eddy current layer 326 such that movement of magnet 330 relative to eddy current layer 326 creates eddy currents within eddy current layer 326 through electromagnetic induction, producing movement resistance and heat or electricity. Movement of the magnet 330 relative to eddy current 326 occurs in the presence of magnetic fields between magnet 330 and eddy current layer 326 which resist relative movement of magnet 330 and eddy current layer 326. As a result, magnet 330 and eddy current layer 326 cooperate to function or serve as a brake or source of resistance against movement of the associative full-length 126 and foot rest 232.

In one implementation, eddy current resistance source 132 is configured similar to rail 24, eddy current layer 26, carriage 28 and magnet 30 of exercise apparatus 10 (described above) such that the relationship between eddy current layer 326 and magnet 330 along the entire length of rail 324 is uniform. In other words, eddy current layer 326 has a uniform or consistent shape, size and material composition along the entire length of rail 324. At the same time, carriage 328 is positioned upon or guided along rail 324 so as to support magnet 330 any uniform or consistent spacing and positioning relative to eddy current layer 326 along the entire longitudinal length of rail 324.

In another implementation, eddy current resistance source 132 is configured similar to rail 54, eddy current layer 56, carriage 58 and magnet 60 of exercise apparatus 50 (described above) such that the relationship between eddy current layer 326 and magnet 330 varies along the longitudinal length of rail 324. For example, in one implementation, the shape, size and/or material composition of eddy current layer 326 varies from one portion to another portion along the longitudinal length of rail 324. In one implementation, rail 324 and/or carriage 328 are configured such that the spacing and positioning of eddy current layer 326 relative to magnet 330 varies along the length of rail 324. By varying the characteristics of eddy current layer 326 or the relative positioning of magnet 330 relative to eddy current layer 326 at different portions along rail 324, different degrees or amounts of resistance are established along the different longitudinal portions of rail 324. For example, in one implementation, rail 324 and carriage 328 are configured so as to interact with one another at end portions of rail 326 such that magnet 330 is moved into a closer position or proximity to eddy current layer 326. As a result, the amount of resistance against movement of eddy current layer 326 proxy to end portions 336 and 338 of rail 324 is enhanced for enhanced braking resistance at the end portions of rail 324.

In one implementation, the relative spacing between eddy current layer 326 and magnet 330 and/or the characteristics of eddy current layer 326 are varied to accommodate different expected speeds or velocities of carriage 328 at different portions of rail 324. Generally, as the speed of carriage 328 along rail the 324 increases, the amount of eddy current and the amount of resistance also increases. By varying the relative spacing between eddy current layer 326 and magnet 330 and/or the characteristics of eddy current layer 326 based upon different expected speeds or velocities of carriage 328 at different portions of rail 324, more level inconsistent amount of resistance and smoother movement of foot rest 232 along the length of rail 324 may be facilitated.

As compared to existing exercise apparatus resistance sources, eddy current resistance source 132 may offer simplification, robustness and lower-cost. In the example illustrated, eddy current resistance source 132 provides resistance against horizontal movement without the use of belts, pulleys and various speed reducing mechanisms which may be complicated, tend to wear and increase the cost of the exercise apparatus which they are employed. As noted above, in some implementations, eddy current resistance source 132 facilitates the provision of different levels of resistance at different portions of the longitudinal stride or movement of foot links 126 and foot rests 232 without complex and costly electronic control.

Figure 6:
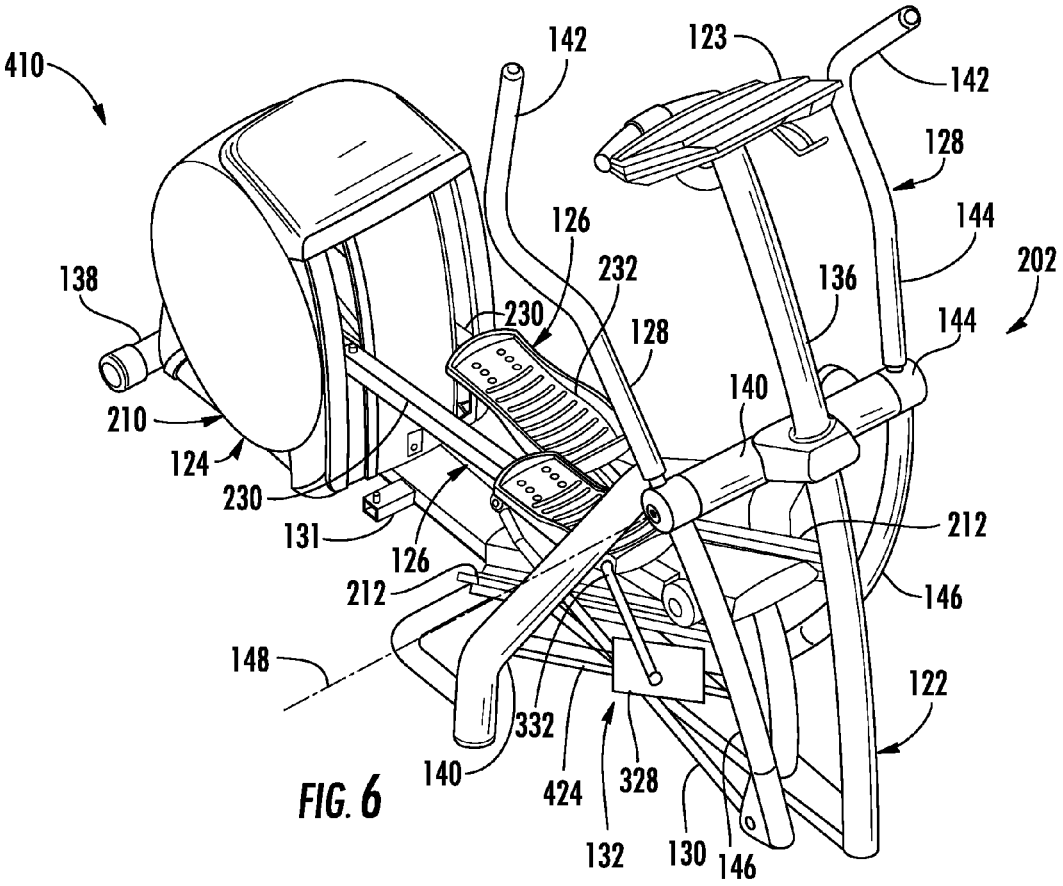
FIG. 6 is a front perspective view of another example exercise apparatus.

FIG. 6 is a perspective view illustrating exercise apparatus 410, another example implementation of exercise apparatus 10. Exercise apparatus 410 is similar to exercise apparatus 110 except that exercise apparatus 410 comprises rail 424 in lieu of rail 324. Those remaining components of exercise apparatus 410 which correspond to components of exercise apparatus 110 are numbered similarly. Rail 424 is similar to rail 304 except that rail 424 is inclined relative to the horizontal. In the example illustrated, rail or extends parallel to the inclined axes of tracks 212. As with rail 324, rail 424 supports that eddy current layer 326 along its length, wherein eddy currents are induced in the eddy current layer 326 (shown in 3) as a result of relative movement of magnet 330 (shown FIG. 3) carried by a carriage 328 resist movement of foot links 126 in their foot rests 232.

Figure 8:
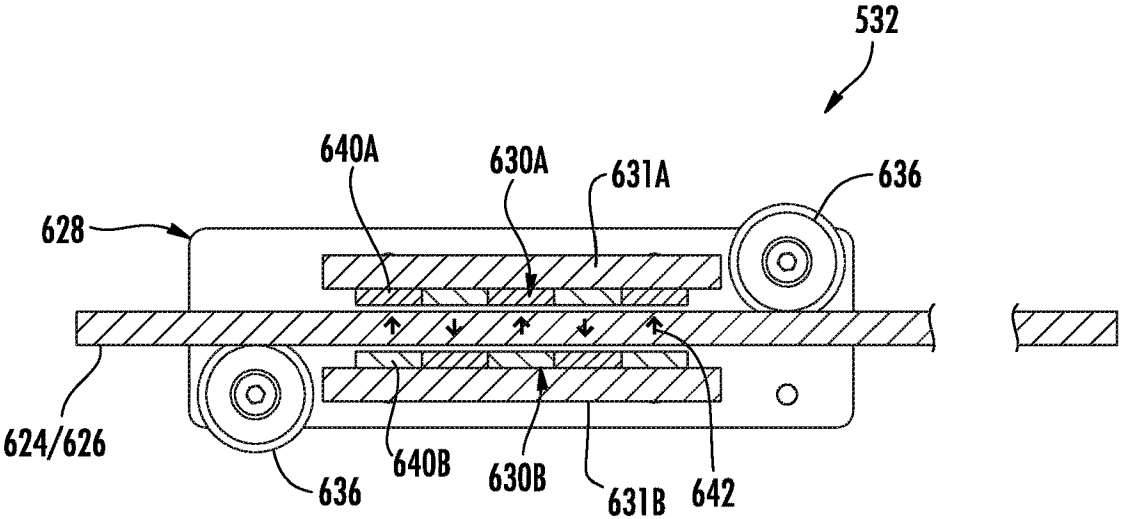
FIG. 8 is a sectional view of the eddy current resistance source of FIG. 7 taken along line 8-8.
Figure 7:
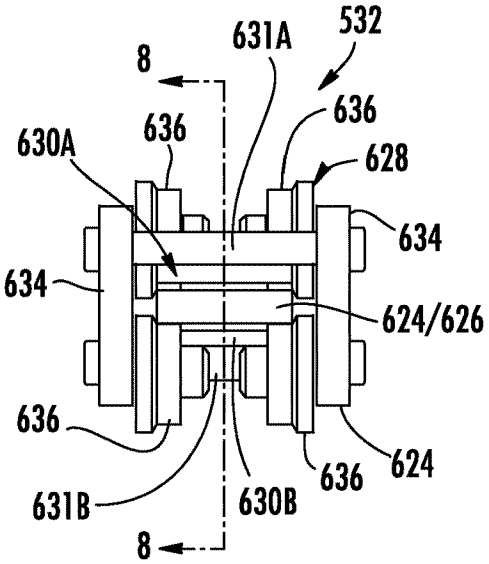
FIG. 7 is a sectional view of an example implementation of an eddy current resistance source of the exercise apparatus of FIGS. 3-6 illustrating a carriage at a first position along a rail.

FIGS. 7 and 8 illustrate eddy current resistance source 532, an example implementation of eddy current resistance source 132. Eddy current resistance source 532 comprises rail 624, eddy current layer 626, carriage 628, magnets 630A, 630B (collectively referred to as magnet 630 and pole plates 631A, 631B (collectively referred to as pole plates 631). Rail 624 comprises an elongate band, beam, rod or other structure along which carriage 628 is guided during movement of a movable member, such as foot link 126 and foot rest 232 shown in FIG. 3. In the example illustrated, rail 624 is formed from an electrically conductive material so as to also serve as eddy current layer 626. In one implementation, rail 624 is formed from an aluminum material so as to also serve as eddy current layer 626. In other implementations, the structure of rail 624 is formed from materials that are not electrically conductive, but wherein a layer of electrically conductive material serving as eddy current layer 626 is coated upon, fastened to, bonded to or otherwise secured to the rail.

Figure 8A:
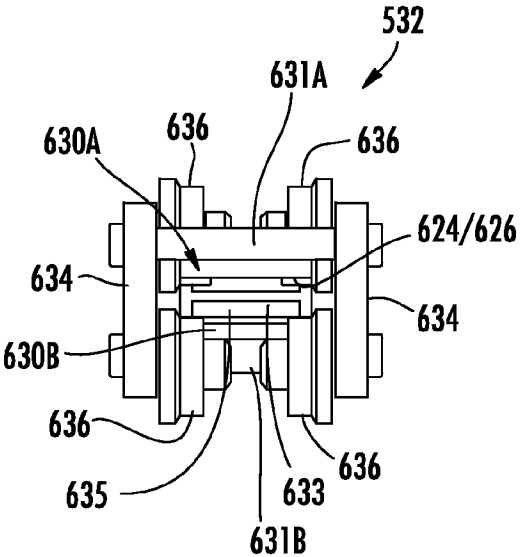
FIG. 8A is a sectional view of the current resistance source of FIG. 7 illustrating the carriage at a second position along the rail.

In one implementation, rail 624/eddy current layer 626 has uniform thickness along the length of rail 624. In another implementation, rail 624/eddy current layer 626 has a varying thickness along the length of rail 624 to provide varying levels of resistance at different longitudinal portions of rail 624. For example, in one implementation, rail 624 may have a varying thickness similar to the varying thickness of eddy current layer 56 of FIG. 1A. In such an implementation, portions of rail 624 transversely between those surfaces upon which guide rollers 636 contact have a reduced thickness at selected portions along the length of rail 624 such that the selected portions have opposite surfaces that are spaced by a greater distance from magnet 630 as compared to other portions along the length of rail 624/eddy current layer 626. For example, FIG. 8A illustrates a carriage 628 positioned along another portion of rail 624/eddy current layer 626. As shown by FIG. 8A, at such portions of rail 624, eddy current layer 626 has an intermediate portion 633 having a reduced thickness on one or both sides so as to form a cavity or depression 635 on each opposite side of rail 624 to increase a spacing between opposite surfaces of rail 624/eddy current layer 626 from magnet 630 so as to reduce braking resistance provided by source 532 when carriage 628 is moving across such portions of rail 624/eddy current layer 626. In one implementation, the location, spacing, density, width, length and depth of cavities or depression 635 are varied along the length of rail 624/eddy current layer 626 to adjust or control the amount of braking resistance provided at different portions along rail 624. In yet other implementations, portions of rail 624/eddy current layer 626 additionally or alternatively have different material compositions having different levels of conductivity to further vary or control the amount of braking resistance provided at different portions longitudinally along rail 624.

Carriage 628 comprises a member that moves along rail 624 while supporting magnets 630 and pole plates 631. In the example illustrated, carriage 628 comprises side plates 634 which rotatably support rollers or guide wheels 636 in engagement with opposite sides or surfaces of rail 624. Guide wheels 636 maintain carriage 628 on rail 624 and maintain a controlled spacing between magnets 630 and eddy current layer 626. In other implementations, other low friction interfaces may be utilized in lieu of guide wheels 636 for slidably or movably supporting carriage 628 along rail 624.

Magnets 630 are supported by carriage 628 on opposite sides of rail 624/eddy current layer 626. In the example illustrated, each of magnets 630 comprises multiple portions of alternating magnetic polarity. The portions with alternating magnetic polarity of magnets 630A and 630B are offset relative to one another such that corresponding portions of magnets 630A and 630B attract one another. For example, magnets 630A has a first portion 640 with a North polarity closest to rail 624/eddy current layer 626 while magnet 630B has a corresponding opposite portion 640B having a South polarity closes to rail 624/eddy current layer 626. As indicated by arrows 642, during movement of carriage 628 along rail 624, eddy currents are induced in a current layer 626 to resist movement of carriage 628 along rail 624.

Pole plates 631, also referred to as attractor plates, extend between side rails 634 on opposite sides of magnets 630. Pole plates 631 are formed from a ferrous material, such as steel. Pole plates 631 focus the magnetic fields to maximize magnetic flux through the gap between magnets 630 and pole plates 631. By intensifying the magnetic flux through the gap between magnets 630 and pole plates 631, pole plates 631 increase the strength of the braking force or resistance produced by the induced parasitic eddy currents across rail 624/eddy current layer 626. In other implementations, one or both of pole plates 631 are omitted.

Figure 11B:
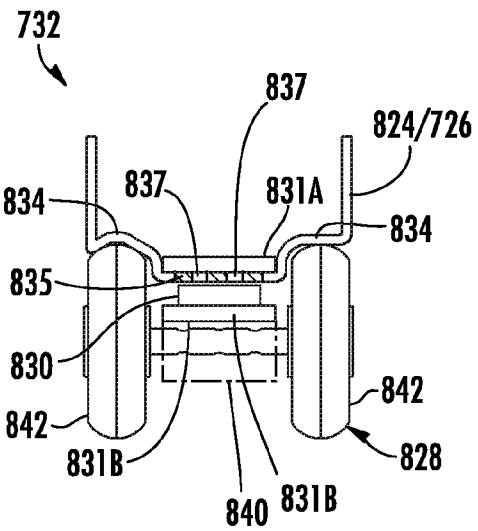
FIG. 11B is a sectional view of the eddy current resistance source of FIG. 9 illustrating the carriage at a third position along the rail.
Figure 11A:
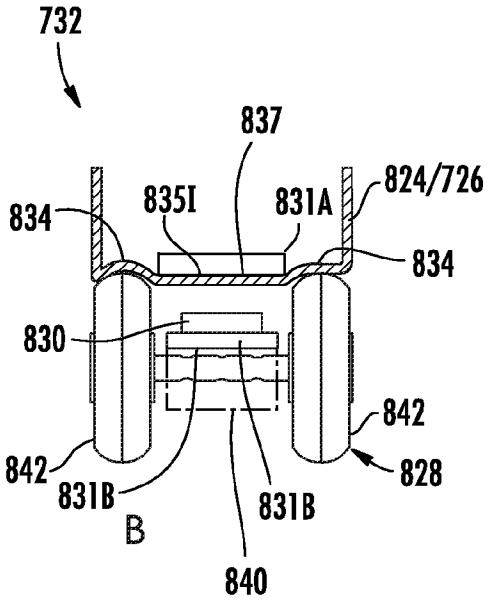
FIG. 11A is a sectional view of the eddy current resistance source of FIG. 9 illustrating the carriage at a second position along the rail.
Figure 10:
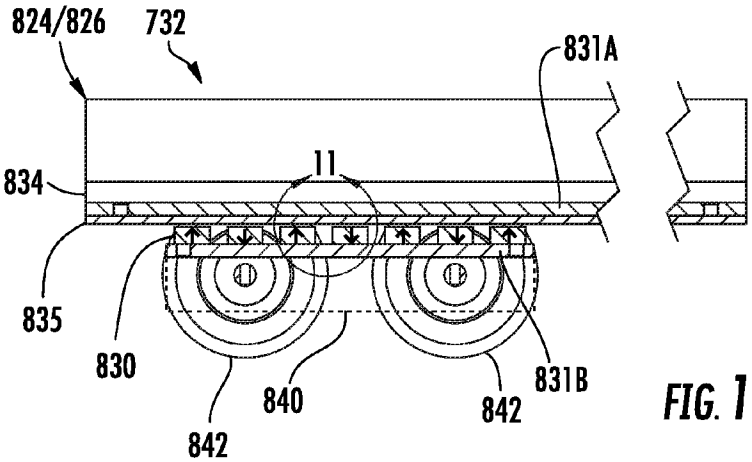
FIG. 10 is a sectional view of the eddy current resistance source of FIG. 9 taken along line 10-10.
Figure 9:
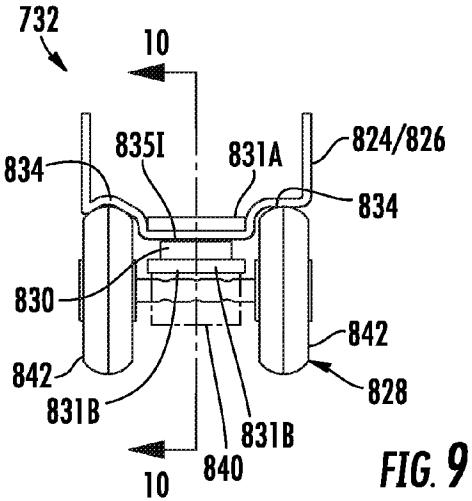
FIG. 9 is a sectional view of another example eddy current resistance source of the exercise apparatus of FIGS. 3-6 illustrating a carriage eddy first position along a rail.
Figure 11:
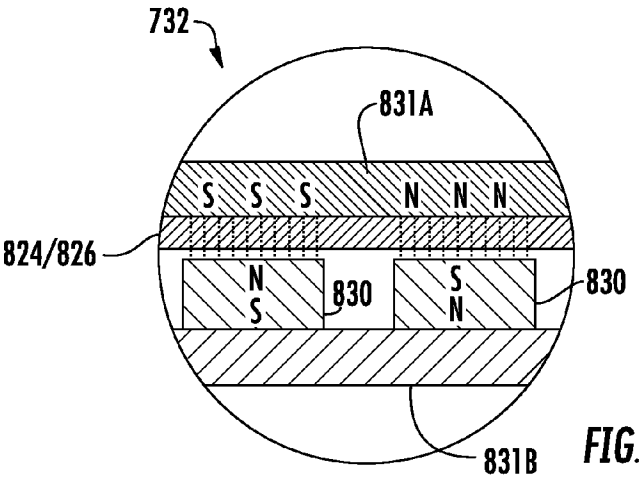
FIG. 11 is an enlarged view of FIG. 10 taken along call out 11.

FIGS. 9-11 illustrate eddy current resistance source 732, another example implementation of eddy current resistance source 132 of FIG. 3. Eddy current resistance source 732 comprises rail 824, eddy current layer 826, carriage 828, magnets 830 and pole plates 831A, 831B (collectively referred to as pole plates 631). Rail 824 comprises an elongate band, beam, rod or other structure along which carriage 828 is guided during movement of a movable member, such as foot link 126 and foot rest 232 shown in FIG. 3. In the example illustrated, rail 824 is formed from an electrically conductive material so as to also serve as eddy current layer 826. In other implementations, the structure of rail 824 is formed from materials that are not electrically conductive, but wherein a layer of electrically conductive material serving as eddy current layer 826 is coated upon, fastened to, bonded to or otherwise secured to the rail.

As shown by FIG. 9, rail 824 comprises a pair of outer tracks 834 and an intermediate eddy current inducement portion 835. Outer tracks 834 extend along the length of rail 824/eddy current layer 826 and provide channels which contain in guide rollers or other interfaces of carriage 828. In the example illustrated, tracks 834 extend above rollers of carriage 828. Eddy current inducement portion 835 extends directly opposite to magnets 830 and faces magnets 830. The spacing between eddy current inducement portion 835 and magnets 830 is controlled by the interaction of the rollers of carriage 828 with tracks 834.

In one implementation, tracks 234 for having uniform shape with respect to inducement portion 835 along the length of rail 824 such that a consistent and uniform spacing between inducement portion 835 and magnets 830 is maintained along the entire length of rail 824 to provide uniform levels of resistance along the length of rail 824. In another implementation, rail 824/eddy current layer 826 is configured to provide varying degrees of resistance along the length of rail 824. For example, in one implementation, tracks 834 have varying shapes or configurations along different portions of the length of rail 824 such that the spacing between inducement portion 835 and magnets 830 varies at different portions along the length of rail 824 to provide varying levels of resistance at different longitudinal portions of rail 824.

FIG. 11A illustrates a carriage 828 positioned along another portion of rail 824/eddy current layer 626. As shown by FIG. 11A, at such portions of rail 824, tracks 834 of rail 824 change in shape or configurations such that intermediate portion 835 of eddy current layer 826 is spaced from magnets 830 by a greater distance as compared to the distance shown in FIG. 9 so as to reduce braking resistance provided by source 732 when carriage 828 is moving across such portions of rail 824/eddy current layer 826.

FIG. 11B illustrates carriage 828 positioned along yet another portion of rail 824/eddy current layer 826. As shown by FIG. 11B, at such portions of rail 824, intermediate portion 835 comprises recesses 837, in the form of craters or depressions extending into portion 835 or in the form of openings extending completely through intermediate portion 835, so as to reduce braking resistance provided by source 732 when carriage 828 is moving across such portions of rail 824/eddy current layer 826. In one implementation, the location, spacing, density, width, length and depth of openings/depressions/recesses 837 are varied along the length of rail 824/eddy current layer 826 to adjust or control the amount of braking resistance provided at different portions along rail 824. As shown by FIG. 11A, in some implementations, braking resistance is further controlled by spacing portion 835 of rail 824, eddy current layer 826 by a greater distance from magnets 830 and by additionally selectively providing recesses 837 through such spaced intermediate portions 835. In yet other implementations, portions of rail 824/eddy current layer 826 additionally or alternatively have different material compositions having different levels of electrical conductivity to further vary or control the amount of braking resistance provided at different portions longitudinally along rail 824.

Carriage 828 comprises a member that moves along rail 824 while supporting magnets 830 and pole plate 831B. In the example illustrated, carriage 628 comprises base 840 which rotatably supports rollers or guide wheels 842 while in engagement with tracks 834. Base 840 is coupled to a movable member, such as foot link 126 (shown in FIG. 3) by one or more linkages. Guide wheels 842 facilitate movement of carriage 628 on rail 624 and interact with tracks 834 to maintain a controlled spacing between magnets 830 and eddy current layer 826. In other implementations, other low friction interfaces may be utilized in lieu of guide wheels 842 for slidably or movably supporting carriage 828 along rail 824.

Magnets 830 are supported by base 840 of carriage 828 above base 840. As shown by FIGS. 10 and 11, magnets 830 comprises multiple portions of alternating magnetic polarity. As a result, magnetic flux through intermediate portion 835 of rail 824/eddy current layer 826 is increased.

Pole plates 831, also referred to as a attractor plates, extend on opposite sides of magnets 830. Pole plates 831 are formed from a ferrous material, such as steel. Pole plates 831 focus the magnetic fields to maximize magnetic flux through the gap between magnets 830 and pole plates 831. By intensifying the magnetic flux through the gap between magnets 830 and pole plates 831, pole plates 831 increase the strength of the braking force or resistance produced by the induced parasitic eddy currents across rail 824/eddy current layer 826. In other implementations, one or both of pole plates 831 are omitted.

As shown by FIGS. 9-11, in addition to facilitating the inducement of eddy currents within the electrically conductive material of rail 824/eddy current layer 826, magnets 830 additionally magnetically retain carriage 828 against and along an underside of rail 824. In one implementation, the carriage is suspended from an underside of the rail solely by magnetic attraction between the magnetic portion (magnets 830) and the ferrous attractor layer (attractor plate 831A). As a result, carriage 828 is easily removed and separated from rail 8244 cleaning, inspection, repair or replacement. Because carriage 828 underlies rail 824, dirt, dust, debris and the like is less likely to accumulate on or within tracks 834 or on carriage 828. In other implementations, the arrangement illustrated in FIG. 9 is flipped such that carriage 828 rides upon rail 824/eddy current layer 826, utilizing gravity to assist the retention of carriage 828 along rail 824. In yet other implementations, tracks 834 alternatively face in horizontal or sideways directions and vertically upward or downward.

For purposes of this disclosure, the phrase "configured to" denotes an actual state of configuration that fundamentally ties the stated function/use to the physical characteristics of the feature proceeding the phrase "configured to". Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An exercise apparatus comprising:

a movable member to be physically contacted by an anatomy of a person exercising;

a rail having an eddy current layer, the rail having a first side and a second side facing away from the first side; and a carriage operably coupled to the movable member so as to be driven along the rail by movement of the movable member, the carriage comprising a magnetic portion spaced from and opposing the eddy current layer, wherein the magnetic portion faces the first side of the rail and wherein the carriage comprises a second magnetic portion spaced from and opposing the eddy current layer, the second magnetic portion facing in a direction towards the second side of the rail opposite the first side and the direction further being towards the magnetic portion.

2. The exercise apparatus of claim 1, wherein the carriage further comprises rollers riding against the rail and spacing the magnetic portion from the eddy current layer.

3. The exercise apparatus of claim 2, wherein the rollers ride on an underside of the rail.

4. The exercise apparatus of claim 1, wherein the rail is aluminum, wherein the magnetic portion comprises a first series of permanent magnets, wherein the second magnetic portion comprises a second series of permanent magnets and wherein the first series and the second series have opposing permanent magnets with opposite polarities, the first series having a first permanent magnet having a first polarity and the second series having a second permanent magnet opposite the first magnet and having a second polarity opposite the first polarity.

5. The exercise apparatus of claim 1 further comprising:

a first roller riding against the first side of the rail and spacing the magnetic portion from the eddy current layer; and a second roller riding against the second side of the rail and spacing the second magnetic portion from the eddy current layer.

6. The exercise apparatus of claim 1, wherein the magnetic portion comprises a series of alternating polarity permanent magnets.

7. The exercise apparatus of claim 1, wherein the rail comprises channels and wherein the carriage comprises rollers received within the channels.

8. The exercise apparatus of claim 1, wherein the rail comprises:

an aluminum layer forming the eddy current layer; and a ferrous attractor layer, wherein the aluminum layer extends between the ferrous attractor layer and the magnetic portion of the carriage.

9. The exercise apparatus of claim 8, wherein the aluminum layer forms channels facing the carriage, wherein the ferrous attractor layer extends between the channels and wherein the carriage comprises rollers received within the channels.

10. The exercise apparatus of claim 8, wherein the carriage is suspended from an underside of the rail solely by magnetic attraction between the magnetic portion and the ferrous attractor layer.

11. The exercise apparatus of claim 1, wherein the movable member comprises a footpad and wherein the exercise apparatus further comprises:

a foot link supporting the footpad;

an extension link pivotably coupled to the foot link and pivotally coupled to the carriage.

12. The exercise apparatus of claim 11 further comprising a crank assembly operably coupled to the foot link to guide movement of the footpad in a continuous elliptical path.

13. The exercise apparatus of claim 1, wherein the rail has a length and wherein spacing between the eddy current layer and the magnetic portion varies along the length.

14. The exercise apparatus of claim 1, wherein the eddy current layer comprises a first portion having a first material composition having a first electrical conductivity and a second portion having a second material composition different than the first material composition so as to have a second electrical conductivity different than the first electrical conductivity.

15. An exercise apparatus comprising:

a frame;

a crank assembly;

a left swing arm pivotably supported by the frame;

a right swing arm pivotably supported by the frame;

a left foot link operably coupled to the left swing arm and the crank assembly;

a right foot link operably coupled to the left swing arm and the crank assembly;

a left rail having a first eddy current layer; and a right rail having a second eddy current layer;

a left carriage operably coupled to the left foot link so as to be driven along the left rail by movement of the left foot link, the left carriage comprising a first magnetic portion spaced from and opposing the first eddy current layer; and a right carriage operably coupled to the right foot link so as to be driven along the right rail by movement of the right foot link, the right carriage comprising a second magnetic portion spaced from and opposing the second eddy current layer.

16. The exercise apparatus of claim 15, wherein the left rail comprises:

an aluminum layer forming the first eddy current layer; and a ferrous attractor layer, wherein the aluminum layer extends between the ferrous attractor layer and the first magnetic portion of the left carriage.

17. The exercise apparatus of claim 16, wherein the aluminum layer forms channels facing the left carriage, wherein the ferrous attractor layer extends between the channels and wherein the left carriage comprises rollers received within the channels.

18. The exercise apparatus of claim 16, wherein the left carriage is suspended from an underside of the left rail solely by magnetic attraction between the first magnetic portion and the ferrous attractor layer.

19. The exercise apparatus of claim 15, wherein the first magnetic portion faces a first side of the left rail and wherein the left carriage comprises a third magnetic portion spaced from and opposing the first eddy current layer, the third magnetic portion facing a second side of the left rail opposite the first side.

20. The exercise apparatus of claim 19, wherein the left rail is aluminum, wherein the first magnetic portion comprises a first series of permanent magnets, wherein the third magnetic portion comprises a second series of permanent magnets and wherein the first series and the second series have opposing permanent magnets with opposite polarities.

21. The exercise apparatus of claim 19, wherein the left carriage further comprises:

a first roller riding against the first side of the left rail and spacing the first magnetic portion from the first eddy current layer; and a second roller riding against the second side of the left rail and spacing the third magnetic portion from the first eddy current layer.

22. An exercise apparatus comprising:

a movable member to be physically contacted by an anatomy of a person exercising;

a rail having an eddy current layer; and a carriage operably coupled to the movable member so as to be driven along the rail by movement of the movable member, the carriage comprising a magnetic portion spaced from and opposing the eddy current layer, wherein the rail comprises:

an aluminum layer forming the eddy current layer; and a ferrous attractor layer, wherein the aluminum layer extends between the ferrous attractor layer and the magnetic portion of the carriage.

23. The exercise apparatus of claim 22 further comprising a second ferrous attractor layer, wherein the magnetic portion is sandwiched between the aluminum layer and the second ferrous attractor layer.

24. An exercise apparatus comprising:

a movable member to be physically contacted by an anatomy of a person exercising;

a rail having an eddy current layer; and a carriage operably coupled to the movable member so as to be driven along the rail by movement of the movable member, the carriage comprising a magnetic portion spaced from and opposing the eddy current layer, wherein the movable member comprises a footpad and wherein the exercise apparatus further comprises:

a foot link supporting the footpad;

an extension link pivotably coupled to the foot link and pivotally coupled to the carriage; and a crank assembly operably coupled to the foot link to guide movement of the footpad in a continuous elliptical path.

* * * * *